US005265532A

United States Patent [19]

DiDonato et al.

[11] Patent Number: 5,265,532

[45] Date of Patent: Nov. 30, 1993

[54] APPARATUS AND METHOD FOR DECORATING CYLINDRICAL CONTAINERS

[75] Inventors: Russell DiDonato, Maplewood; Chester Chrobocinski, Carteret, both of N.J.

[73] Assignee: Sequa Corporation, New York, N.Y.

[21] Appl. No.: 961,206

[22] Filed: Oct. 13, 1992

Related U.S. Application Data

[63] Continuation of Ser. No. 666,387, Mar. 8, 1991, abandoned.

[51] Int. Cl.[5] ..... B41F 17/08

[52] U.S. Cl. ..... 101/40; 101/38.1; 101/76

[58] Field of Search ..... 101/38.1, 39, 40, 40.1, 101/76, 212, 217, 483, 490

[56] References Cited

U.S. PATENT DOCUMENTS

| | | | |
|---|---|---|---|
| 3,261,281 | 7/1966 | Hartmeister | 101/40 X |
| 3,348,478 | 10/1967 | Gancarz et al. | 101/76 X |
| 3,613,571 | 10/1971 | Russell et al. | 101/40 |
| 4,327,637 | 5/1982 | Fujimori | 101/40 |
| 4,884,504 | 12/1989 | Sillars | 101/76 X |

FOREIGN PATENT DOCUMENTS

92/09435 6/1992 PCT Int'l Appl. .

*Primary Examiner*—Edgar S. Burr
*Assistant Examiner*—Lynn D. Hendrickson
*Attorney, Agent, or Firm*—Mitchell D. Bittman; Jerome M. Berliner

[57] ABSTRACT

A continuous motion decorator for cylindrical containers is provided with a direct printing unit for printing an auxiliary image on the cylindrical surface of a container that has been imprinted with a main image by an offset blanket segment of the decorator. The direct printing unit includes a plurality of direct printing plates disposed in tandem on a closed loop belt means with each of these plates bearing a different auxiliary image. The offset blanket segments are mounted on the periphery of a continuously rotating blanket wheel. An individual direct printing unit, mounted to the blanket wheel, is provided for each blanket segment and includes an anvil disposed at the upstream end of the blanket segment to support one printing plate at a time in its printing position. For each revolution of the blanket wheel the belt means is advanced by an incremental length to bring a new printing plate to printing position. The direct printing unit is mounted on a pivot support and is adjustably positionable as a unit to adjust direct printing pressure. The direct printing unit may be positioned so that its plates do not contact containers to which main images are applied. In addition, the direct printing unit may be deactivated so that the belt means is not stepped as the blanket wheel rotates.

16 Claims, 9 Drawing Sheets

FIG. 6.
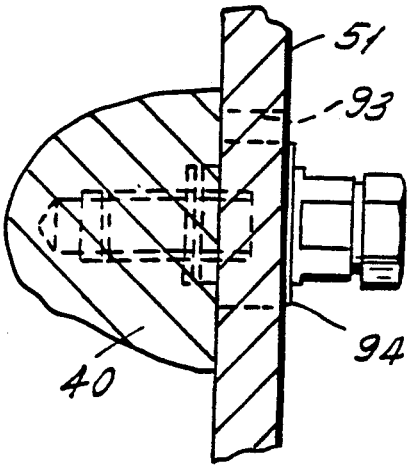
FIG. 7.
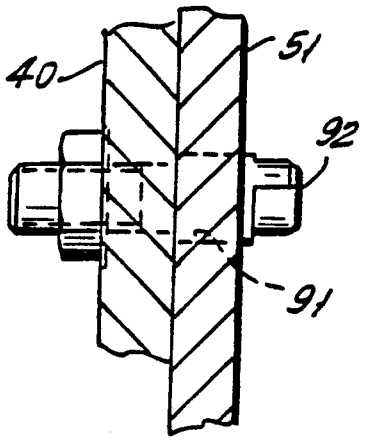
FIG. 8.
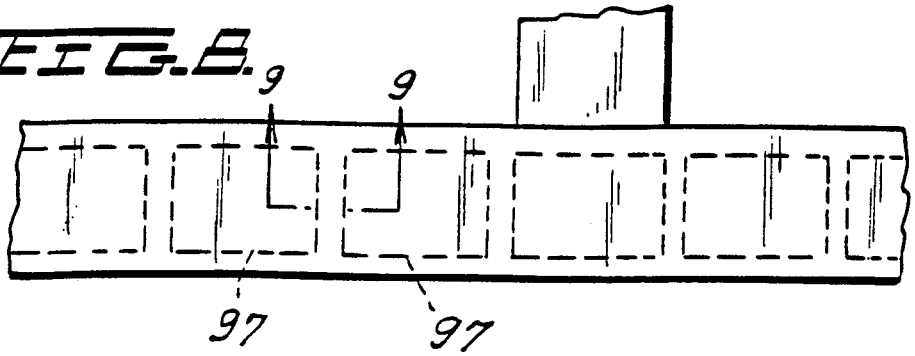
FIG. 9.
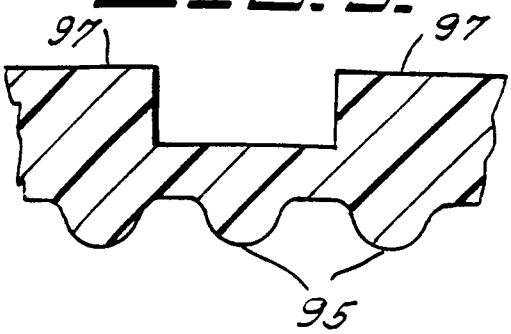
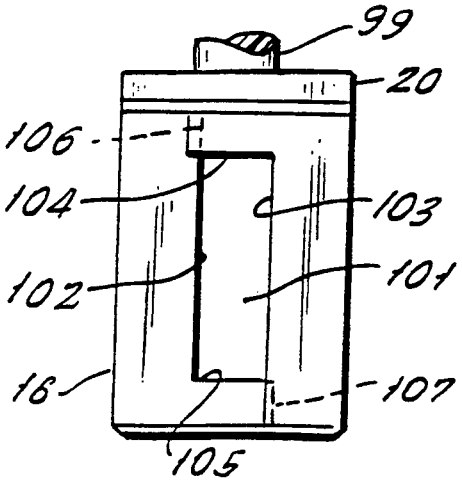
FIG. 10.

165
143
161
166
164
174
143
147
176
173
172
167
178
162
168
166
159
161
160
13
146
143
13
163
12
201
158
159
145
160
161
162
148
182
149
153
155
154
150
151
152
156

APPARATUS AND METHOD FOR DECORATING CYLINDRICAL CONTAINERS

This is a continuation of application Ser. No. 07/666,387 filed on Mar. 8, 1991, now abandoned.

BACKGROUND OF THE INVENTION

This invention relates to high speed continuous motion can decorators and more particularly relates to a can decorator of this type which, in addition to utilizing offset means for printing a main image, provides auxiliary image printing plates that make direct engagement with the can.

U.S. Pat. No. 4,921,093 issued May 1, 1990 to A. Peters et al. entitled Infeed Means for High Speed Continuous Motion Can Decorator discloses high speed continuous motion can decorating apparatus that utilizes offset printing techniques for decorating all cans with the same indicia. Other examples of continuous motion high speed can decorators of this type are also disclosed in U.S. Pat. Nos. 3,563,170, 3,766,851 and 3,976,187.

In accordance with the instant invention the device of the '093 patent is modified by adding a plurality of direct printing units the latter having print indicia that is changed for each revolution of a continuously rotating mandrel wheel that carries the cans through a printing zone where both main (printed by offset blanket segments) and auxiliary images (printed by the direct printing units) are applied thereto. In a broad sense this type of arrangement is disclosed by U.S. Pat. No. 4,884,504 issued Dec. 5, 1989 to I. Sillars for a Method for Printing of Quasi-Random Number Tables on Cylindrical Objects. The combination of offset and direct printing on a single object is also disclosed in U.S. Pat. No. 2,660,111 issued Nov. 24, 1953 to W. Herrick et al. for a Postage Printing Device Using Direct and Offset Printing.

SUMMARY OF THE INVENTION

Accordingly, the primary object of the instant invention is to provide an improved construction for direct printing units that are carried by a continuously rotating offset printing blanket wheel of a continuous motion apparatus for decorating cylindrical objects.

Another object is to provide apparatus of this type constructed so that the direct printing units are readily mounted and dismounted from the blanket wheel.

Still another object is to provide a direct printing unit of this type that having means that permits adjustment of direct printing pressure without dismounting the unit from the blanket wheel.

A further object is to provide apparatus of this type in which each of the direct printing units utilizes a timing belt to impart step-like motion to direct printing plates that are mounted along the length of the timing belt on the surface thereof opposite the timing belt surface having transverse driving teeth.

A still further object is to provide a novel method for decorating cylindrical objects by utilizing a combination of offset and direct printing techniques.

Yet another object is to provide a method of this type in which the container is positively rotated about its own axis during direct printing thereon at the same speed used for offset printing thereon.

These objects as well as other objects of this invention shall become readily apparent after reading the following description of the accompanying drawings in which:

BRIEF DESCRIPTION OF THE DRAWINGS

FIG. 6 is a fragmentary cross-section of the eccentric for adjusting printing pressure of the direct print unit.

FIG. 7 is a fragmentary cross-section of one of the mounting pivots for the direct printing unit.

FIG. 8 is a fragmentary view of the front surface of a relatively narrow printing belt.

FIG. 9 is a cross-section taken through line 9—9 of FIG. 8 looking in the direction of arrows 9—9.

FIG. 10 is a side elevation of a decorated can mounted on a mandrel.

DETAILED DESCRIPTION OF THE DRAWINGS

Figure 1:
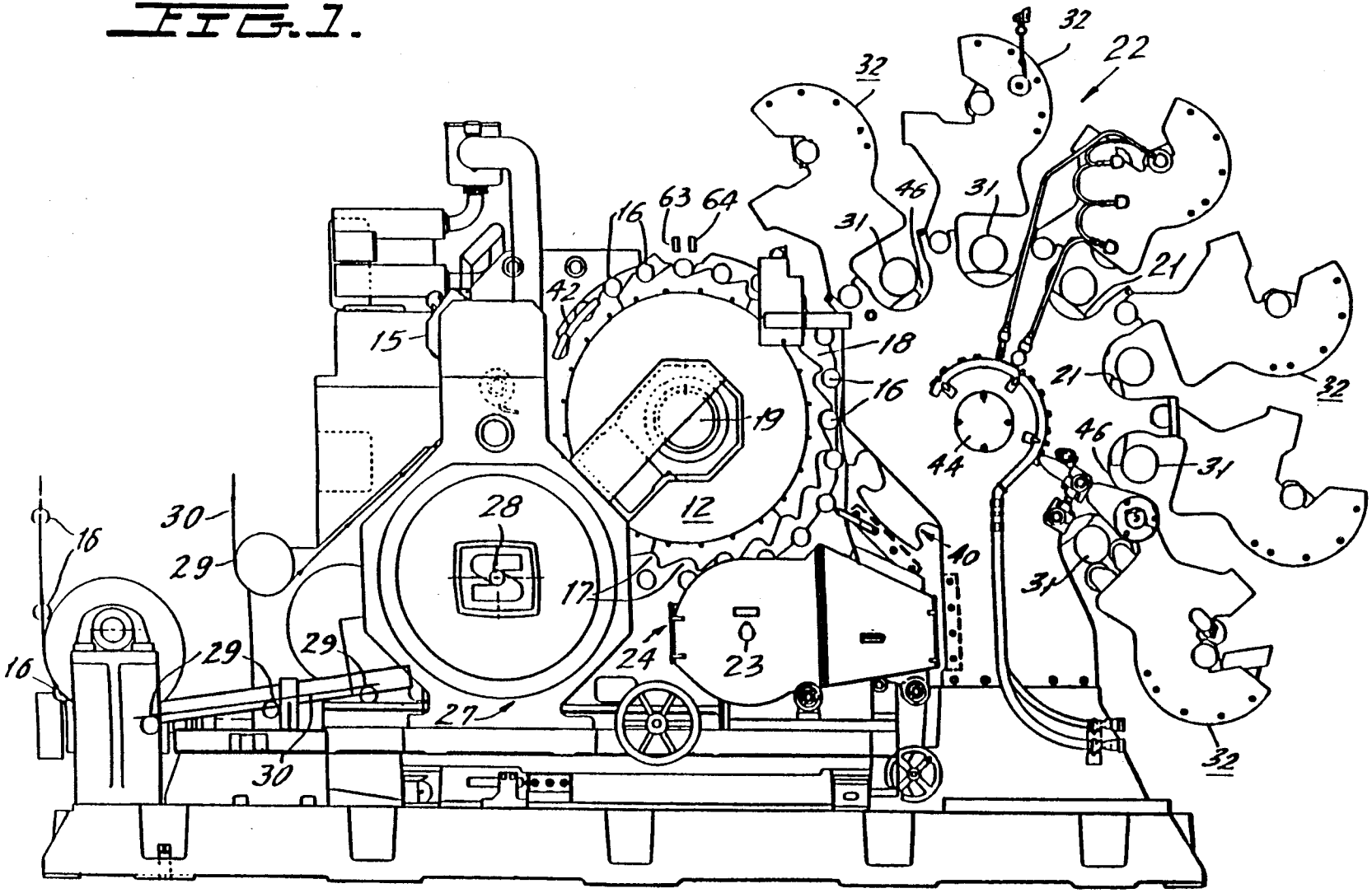
FIG. 1 is a front elevation of continuous motion can decorating apparatus constructed in accordance with teachings of the instant invention.

Now referring to the Figures and more particularly to FIG. 1 which illustrates continuous motion cylindrical container decorating apparatus of the general type described in U.S. Pat. No. 4,140,053 issued Feb. 20, 1979 to J. P Skrypek et al for a Mandrel Mounting and Trip Mechanism for Continuous Motion Decorator, as well as in the aforesaid U.S. Pat. No. 4,921,093 issued May 1, 1990 to A. Peters et al.

Briefly, the apparatus of FIG. 1 includes infeed conveyor chute 15 which receives cans 16 from a supply not shown and directs them to arcuate cradles or pockets 17 along the periphery of spaced parallel rings secured to pocket wheel 12. The latter is fixedly secured to continuously rotating mandrel carrier wheel 18 which in turn is keyed to continuously rotating horizontal drive shaft 19. Horizontal spindles or mandrels 20, each rotatable about its own cylindrical axis, are mounted to wheel 18. As is well-known to the art, each spindle 20 is in spaced axial alignment with an individual pocket 17 in a short region extending downstream from infeed conveyor 15. Each undecorated can 16 is transferred from each pocket 17 to a mandrel by wiping against stationary arm 42 which is angled inwardly in the downstream direction so as to function as a cam that drives can 16 horizontally (axially) toward mandrel 20. Suction applied to an axial passage of mandrel 20 draws the latter to final seating position.

While mounted on mandrels 20 cans 16 are decorated by being brought into engagement with one of the image transfer mats or blanket segments 21 of the multicolor printing unit indicated generally by reference numeral 22. Thereafter, and while still mounted on mandrels 20 the outside of each decorated can 16 is coated with a protective film or varnish applied by engagement with the periphery of rotating applicating roll (not shown) rotating on shaft 23 in the overvarnish unit indicated generally by reference numeral 24. Can 16 with decorations and a protective coating thereon are then transferred from mandrels 20 to suction cups (not shown) mounted along the periphery of transfer wheel (not shown) rotating on shaft 28 of transfer unit 27. In transfer unit 27 cans 16 are deposited on generally horizontal pins 29 carried by chain-type output conveyor 30 which carries cans 16 through a curing oven (not shown).

While moving toward engagement with an undecorated can 16 each blanket segment 21 engages a plurality of printing cylinders 31 each of which is associated an individual ink unit 32. In a manner well-known to the art, each of the inker units 32 includes a plurality of doctor elements that produce a controlled film of ink that is applied to a printing cylinder 31. Each unit 32 provides a different color ink and each printing cylinder 31 applies a different image segment to blanket segments 21 All of these image segments are combined to produce a main image on each blanket segment 21, which main image is transferred to undecorated cans 16 in a printing region that commences slightly counterclockwise of the most counterclockwise printing cylinder 31.

Figure 2:
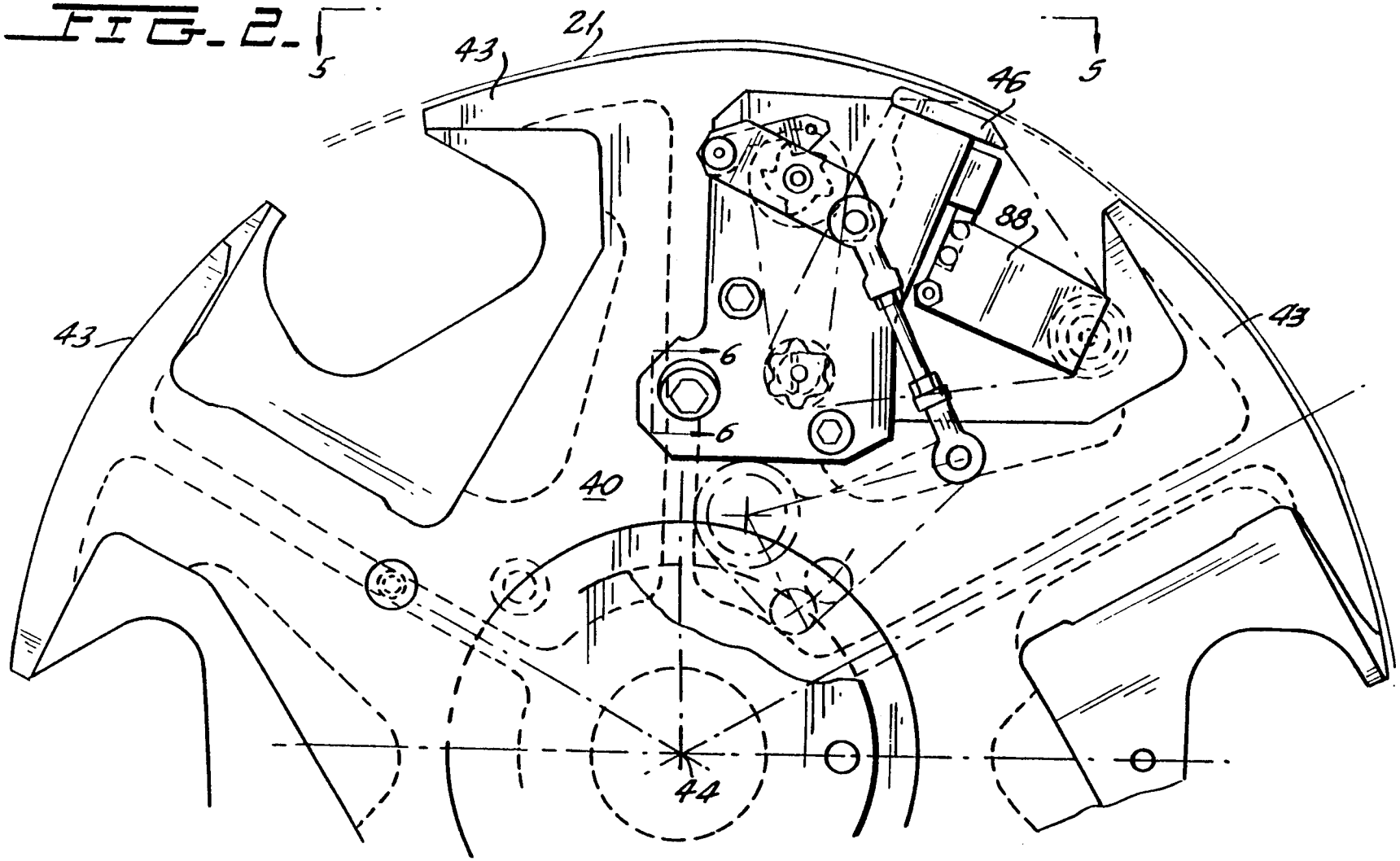
FIG. 2 is an enlarged front elevation illustrating a fragmentary portion of the blanket wheel and one of the direct printing unit mounted thereto.

As seen in FIG. 2 each of the blanket segments 21 is cemented to an individual segment 43 along the periphery of generally hollow blanket wheel 40 that rotates continuously about its central axis 44 as a center. Associated with each segment 43 and removably mounted to blanket wheel 40 is an individual direct printing unit 45 that includes anvil 46 disposed immediately upstream of segment 43 generally in curved alignment with blanket segment 21. Each direct printing unit 45 is constructed of vertically extending spaced parallel side plates 51, 52 that support a plurality of horizontal shafts and elements mounted thereto including anvil 46. More particularly, lower shaft 53 extends between plates 51, 52 and through the former to the outside of unit 45 where manually engageable knob 54 is mounted thereto. Keyed to shaft 53 is sprocket 54 that is connected through drive belt 55 to drive sprocket 56 that is pivotally mounted on upper shaft 57 which also extends between plates 51, 52 and projects through the former to the outside of unit 45 where ratchet wheel 58 is keyed to shaft 57. For a reason that will become apparent drive sprocket 56 and shaft 57 are mounted on respective one-way clutches 61, 62.

Rocker 59 is pivotally mounted on shaft 57 outboard of plate 51. End 63 of pawl 60 is pivotally mounted to rocker 59 and the other end 64 of pawl 60 is biased clockwise with respect to FIG. 3 against the toothed periphery of ratchet wheel 58 by tension spring 65 that is connected at its ends 66, 67 to projections that extend respectively from pawl 60 and rocker 59. When rocker 59 is pivoted counterclockwise with respect to FIG. 3 pawl 60 drives ratchet wheel 58 counterclockwise thereby driving shaft 57 counterclockwise, with the latter acting through one-way clutch 61 to drive sprocket 56 counterclockwise. Clockwise pivoting of rocker 59 causes pawl end 64 to ride along the periphery of ratchet wheel 58 with the latter being maintained against movement by one-way clutch 62.

The end of rocker 59 remote from pawl 60 is connected at pivot means 71 to one end of connecting link means 70 whose other end is connected by pivot means 72 to another rocker 75 that is mounted by pivot means 76 to blanket wheel 40. Cam follower roller 77 is mounted to freely rotate on rocker 75 at a point remote from the attachment of link 70. Follower 77 rides in closed loop cam track or groove 78 that is cut in the left fact of plate 79 (FIG. 5) which is fixedly secured to stationary frame 80 that supports blanket wheel 40. As the latter rotates, cam track 78 drives follower 77 toward and away from the rotational axis for blanket wheel 40, with the most radial inward position of the center for follower 77 being indicated by arc 81 (FIG. 3) and the most outward position being indicated by arc 82. Movement of follower 77 radially outward pivots rocker 75 counterclockwise with respect to FIG. 3 thereby driving link 70 so that rocker 59 also pivots counterclockwise and in so doing carries pawl 60 so that it steps ratchet wheel 58 an incremental distance counterclockwise. This steps shaft 57 with sprocket 56 mounted thereon. The latter acts through timing belt 55 to drive sprocket 54 that is keyed to lower shaft 53. Also keyed to lower shaft 53 are sprockets 83, 84 that are maintained in spaced relationship by sleeve 86. Sprockets 83, 84 drivingly support the ends of relatively wide flexible timing belt 85 in the form of a closed loop that is also defined by anvil 46 and tension roller 87. A fragmentary longitudinal cross-section of belt 85 is seen in FIG. 9. Transverse teeth 95 are formed along the inner surface and raised portions 97 which form the auxiliary image receive ink that is applied directly to cans 16. Roller 87 is mounted on arm 88 which is mounted to pivot 89 of anvil support 91 by connecting strip 92. The opposite ends of anvil support 91 are secured to the respective side plates 51, 52. Eccentric 93, pivotally mounted on arm 88 and having its edge engaged with support 91, provides means for adjusting the position of roller 87 to tension belt 85.

Figure 3:
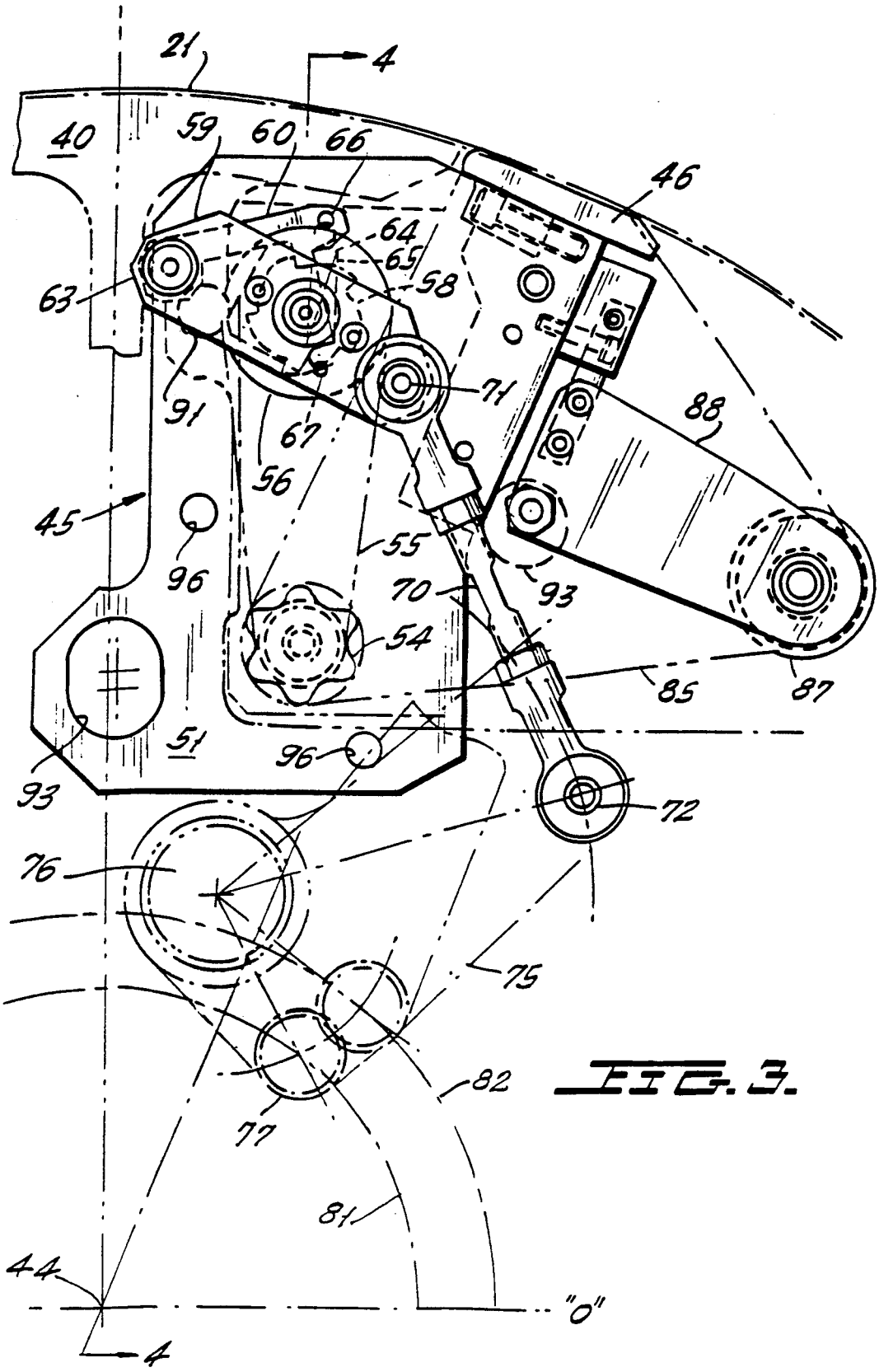
FIG. 3 is an enlarged front elevation of a direct printing unit constructed in accordance with teachings of the instant invention.
Figure 4:
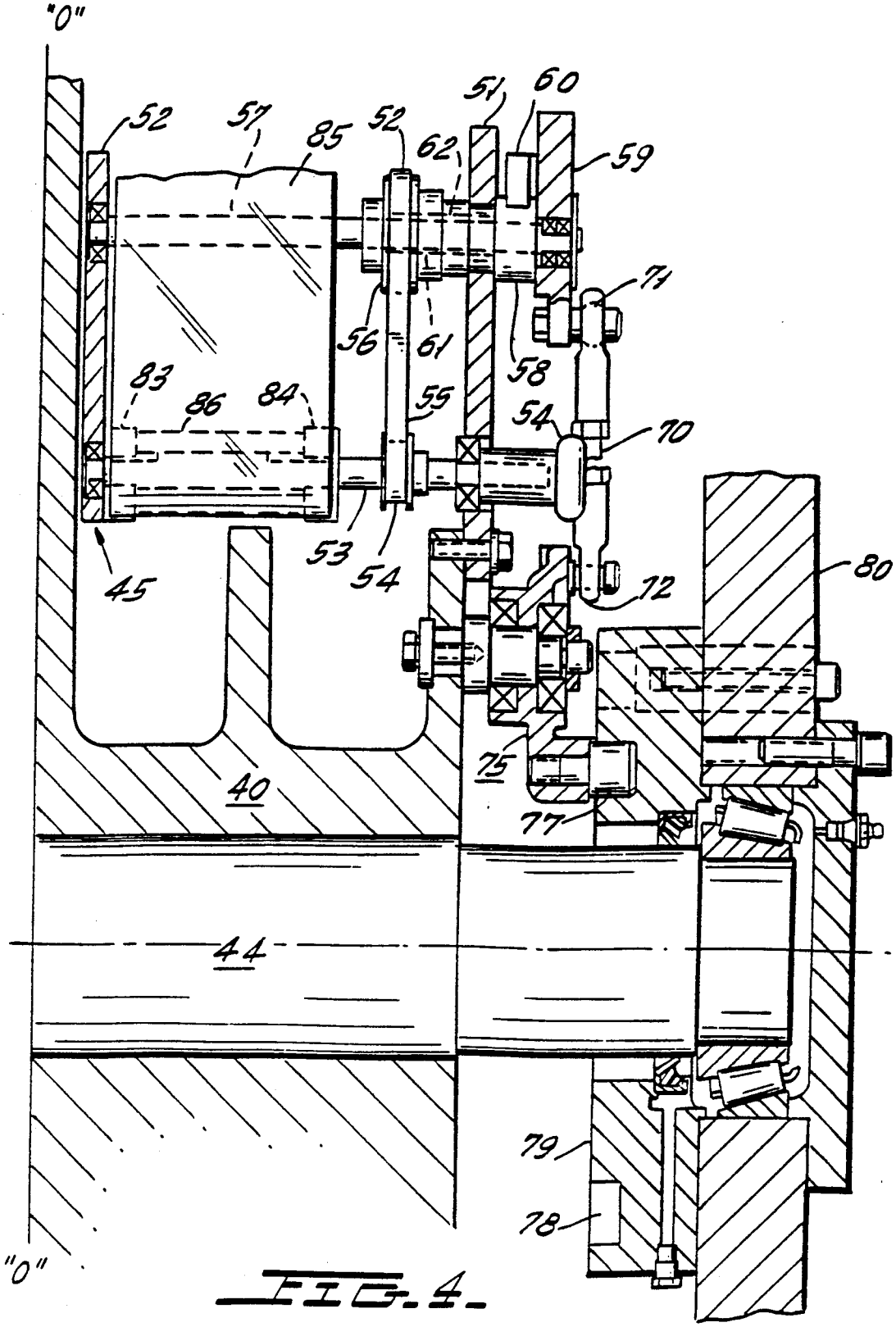
FIG. 4 is a cross-section taken through line 4—4 of FIG. 3 looking in the direction of arrows 4—4.

For each revolution of blanket wheel 40 belt 85 is stepped by an incremental distance so that a different portion on the outer surface thereof is supported by anvil 46 in a position to be engaged by an undecorated can 16 after the latter has most if not all of the main image applied thereto by rolling over blanket segment 31 counterclockwise of anvil 46 in FIG. 3. Belt 85 is a timing belt having driving ribs extending completely across the interior surface thereof. The exterior surface of belt 85 is divided into incremental lengths that will be supported one at a time by anvil 46. Each of these incremental lengths comprises a different indicia in the form of illustrations, and/or numbers. Ink is applied to the exterior or printing plate surface of the incremental length supported by anvil 46, either by a printing cylinder 31 dedicated for that purpose only or a printing cylinder 31 having a raised portion shaped and disposed to engage the direct printing plate segment of belt 85.

Direct printing unit 45 is provided with axially aligned apertures 91 in side plates 51, 52 which receive horizontally extending support pins 92 (FIG. 7) that extend in the same direction from spaced vertical walls of blanket wheel 40 with the pin 92 that extends through aperture 91 of plate 52 being longer than pin 92 that extends through aperture 91 of plate 51. Plate 51 is also provided with vertically elongated oval aperture 93 to receive eccentric 94 (FIG. 6) that projects outboard from blanket wheel 40 and is pivotally mounted thereto. The rotation of eccentric 94 adjusts the position of anvil 46 by pivoting unit 45 about aligned mounting pins 92, 92 as a center thereby adjusting engagement pressure between printing belt 85 and can 16. Side plate 51 is also provided with oversized clearance apertures 96, 96. An individual locking screw 97 passes through each aperture 96 and is threadably received by an aperture in blanket wheel 40 to lock direct printing unit 45 in its adjusted position on blanket wheel 40.

It should now be apparent to those skilled in the art that for each revolution of a direct printing unit 45 about axis 44 of blanket wheel 40 there will be a single increment advance of belt 85, so that a new printing plate is supported by anvil 46 for each revolution of wheel 40. All decorations, both main and auxiliary, have been applied to can 16 by the time anvil 46 of direct printing unit 45 reaches the approximately eight o'clock position with respect to FIG. 1. Cam track 78 shaped so that shortly after anvil 46 reaches this eight o'clock position, rocker 75 is driven counterclockwise to step belt 85 by a single increment. Each incremental step is completed before belt 85 is engaged by an ink applicating means. Belt 85 remains stationary with respect to anvil 46 while ink is applied to the printing plate that is supported by anvil 46. This fixed relationship is maintained while the auxiliary image is printed on can 16. Thereafter, each time anvil 46 moves past the eight o'clock position belt 85 is advanced an incremental distance.

Figure 5:
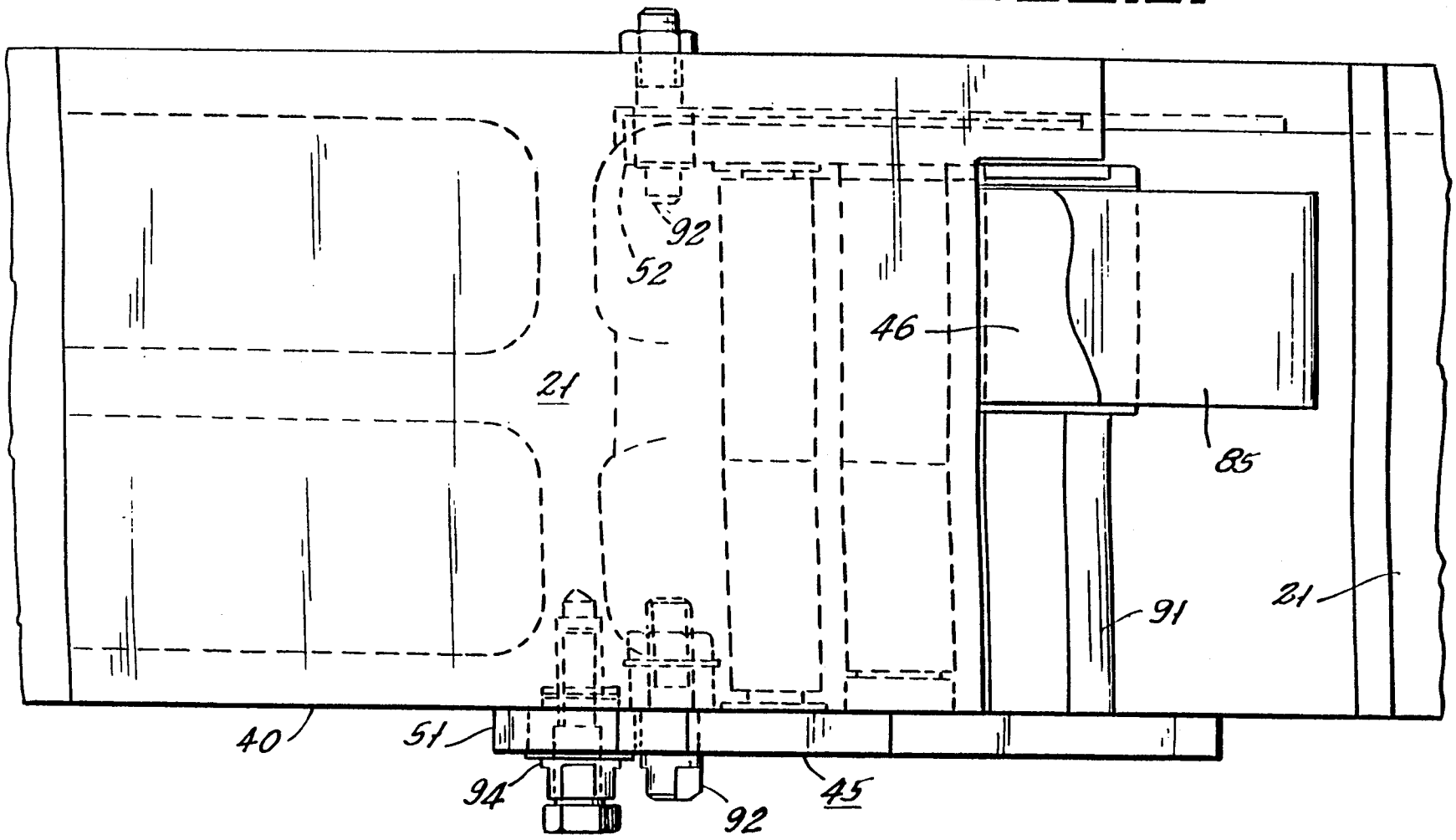
FIG. 5 is a fragmentary edge view of the blanket wheel looking in the direction of arrows 5—5 of FIG. 2.
Figures 11, 12, 13:
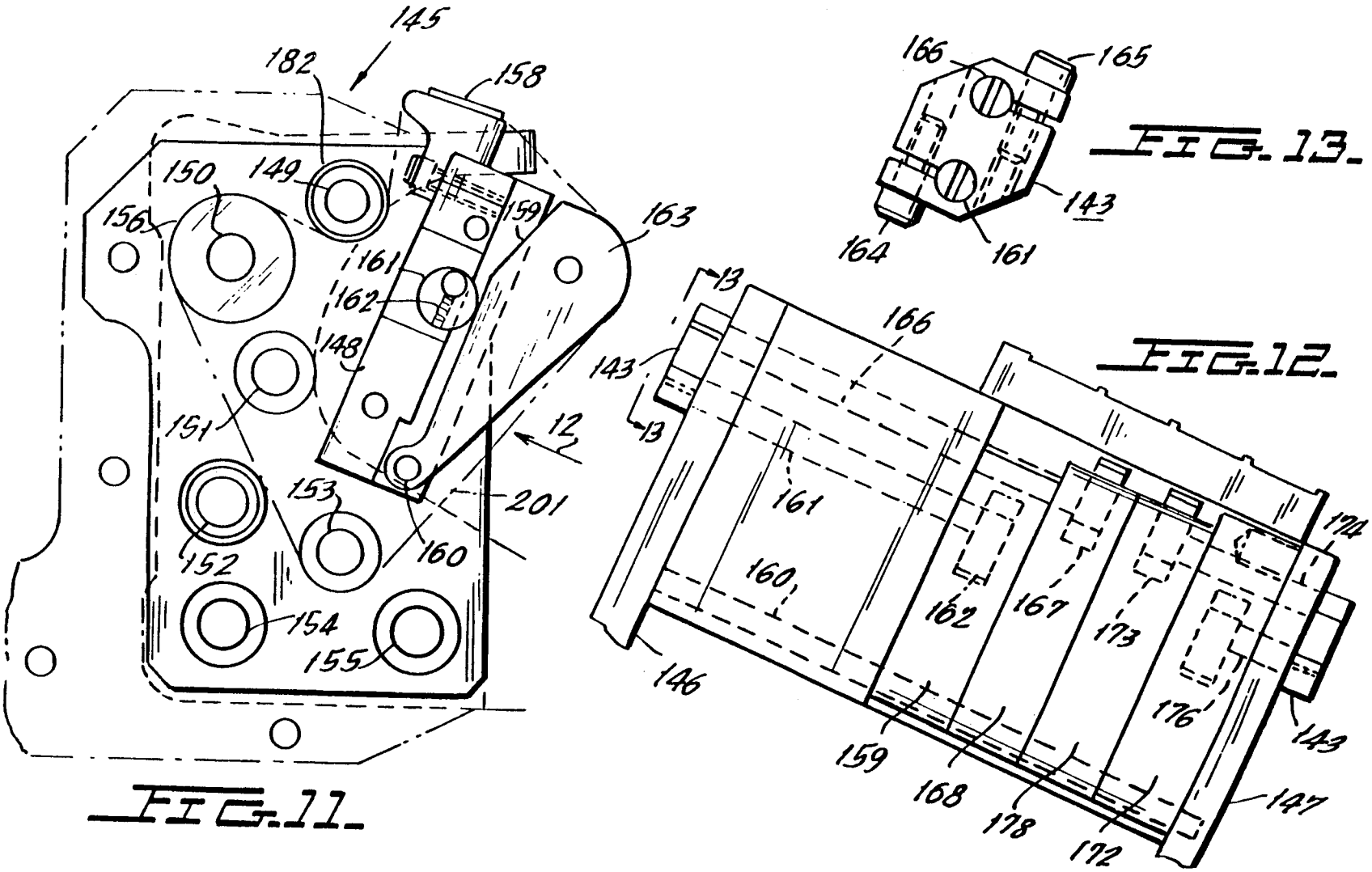
FIG. 11 is a side elevation of a direct printing unit constructed in accordance with teachings of a second embodiment of the instant invention.
FIG. 12 is an enlarged fragmentary end view of the direct printing unit of FIG. 11 looking in the direction of arrow 12 in FIG. 11.
FIG. 13 is a side elevation of a locking device looking in the direction of arrows 13—13 of FIG. 12.
Figure 14:
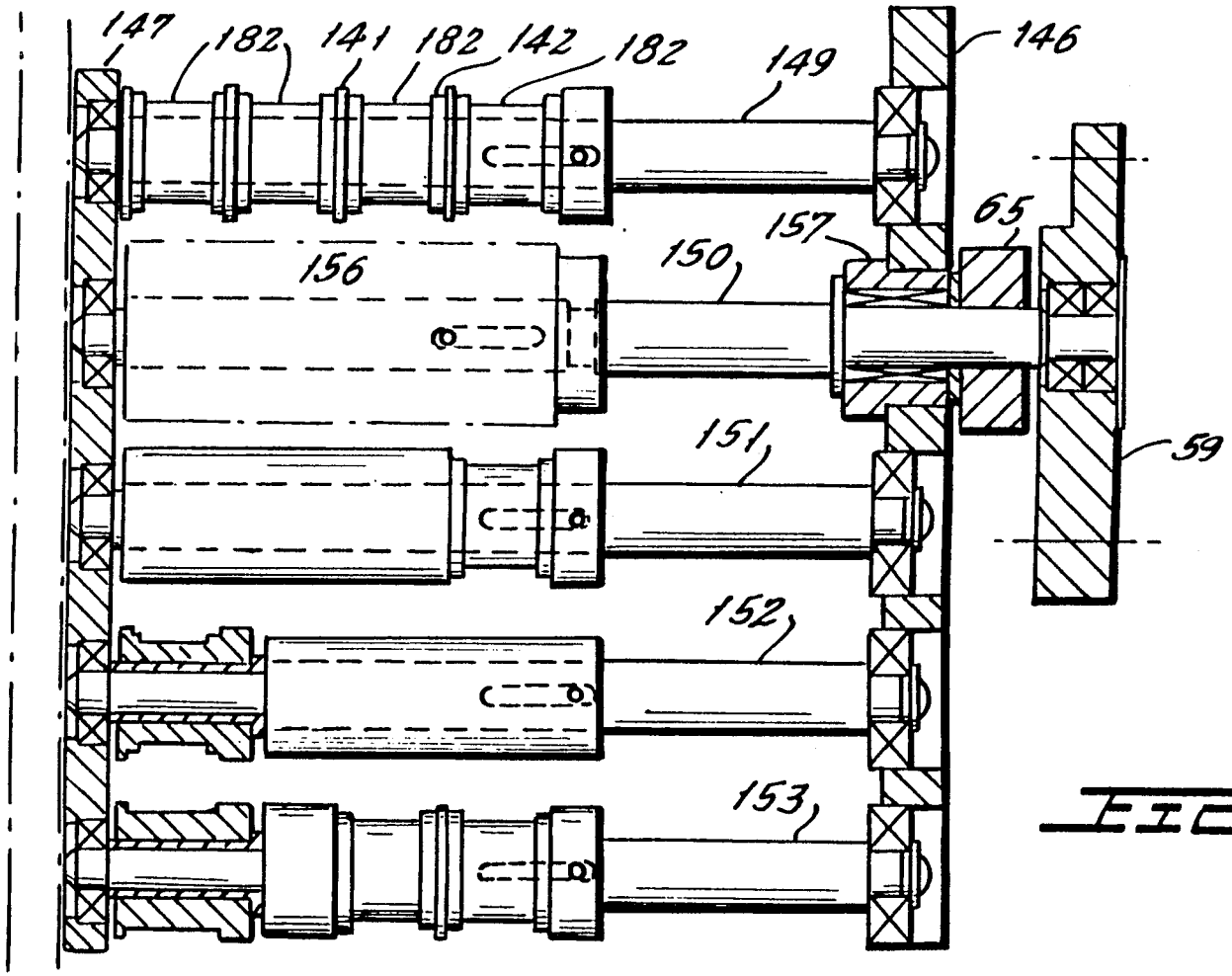
FIG. 14 is an expanded view illustrating the relationship between the drive sprocket and certain other elements which define paths for the closed loop printing belts.
Figure 15:
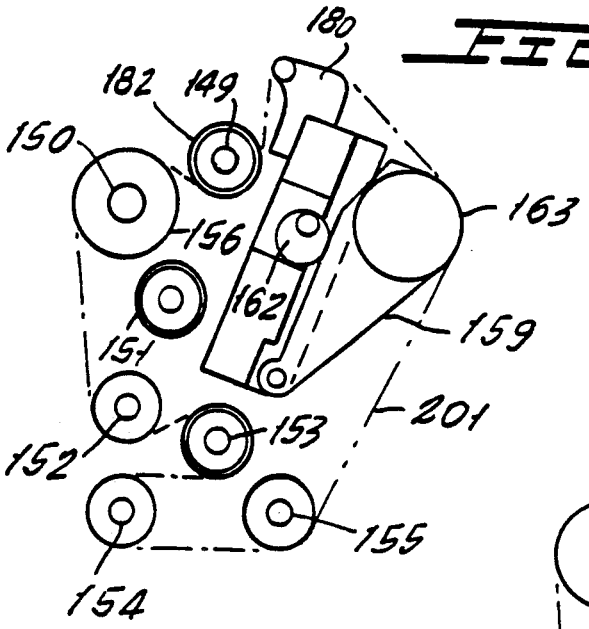
FIGS. 15 through 18 are schematics illustrating the paths taken by the respective closed loop printing belts.
Figure 16:
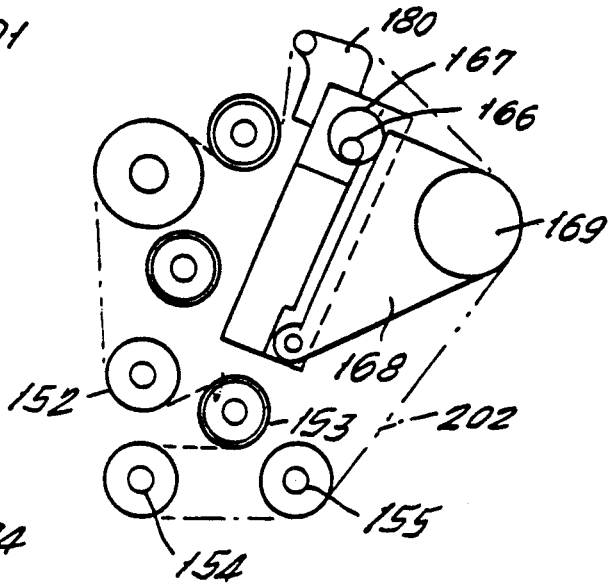
Figure 17:
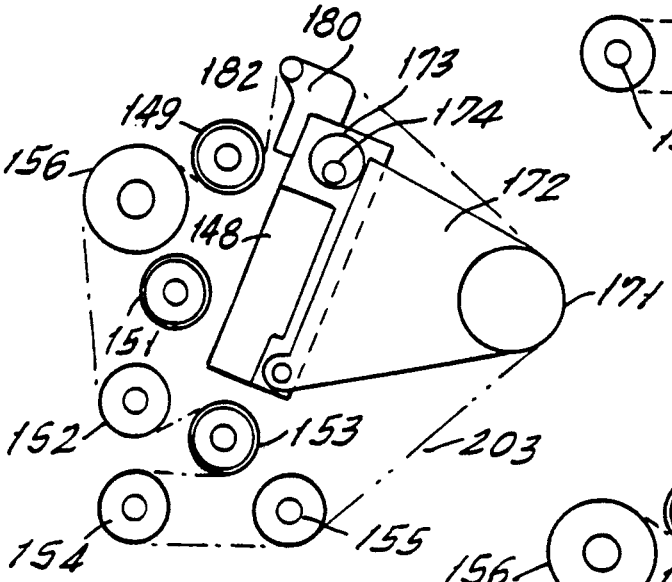
Figure 18:
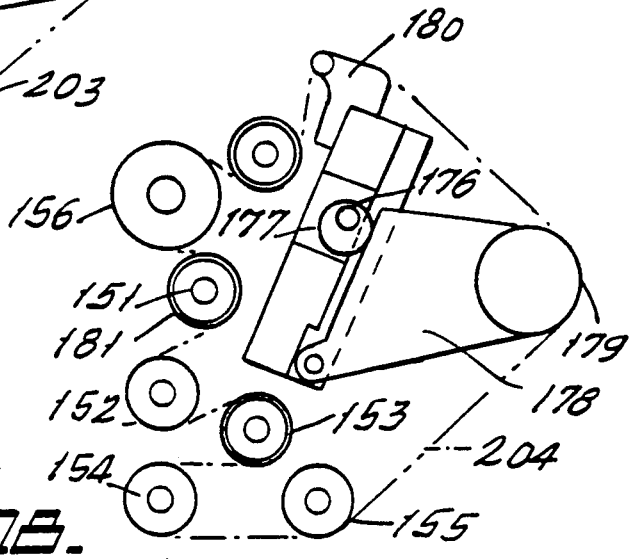

As seen in FIG. 5, blanket supporting segment 43 and blanket segment 21 supported thereby are notched to form upstream extension 98 at one side of blanket segment 31. Anvil 46 is positioned in the notched portion of blanket segment support 43. Extension 98 frictionally engages the sidewall of can 16 adjacent the open end thereof and/or frictionally engages mandrel 20 so that can 16 is positively rotated about mandrel axis 99 while can 16 is in direct engagement with a printing plate that is supported by anvil 46 so that while the auxiliary image is being applied to can 16 rotation of the latter is not dependent solely upon a friction force derived from direct engagement between belts 85 and can 16.

The auxiliary image is printed by belt 85 in a field 101 (FIG. 10) that is formed when the main image is applied to can 16 by engagement thereof with offset blanket segment 21. A portion of the main image is transferred from extension 98 of blanket segment 30. In FIG. 10, field 101 is illustrated as being a blank rectangular space having its major axis parallel to the rotational axis for can 16. In particular, field 101 is defined by spaced relatively long parallel main sides 102, 103 connected by relatively short ends 104, 105. When the main image is applied to can 16, end 105 is the first boundary portion of field 101 to be formed. Thereafter, side 102 is formed, followed by side 103 followed by end 104. There are slight overlaps 106, 107 where the sections forming ends 104, 105, respectively, overlap other portions of the main image. It should now be apparent that the portion of main image which forms end 104 of field 101 is applied by blanket extension 98.

It is noted that it is unnecessary to dismount direct printing unit 45 from blanket wheel 40 in order to stop printing of auxiliary images. That is, for the most clockwise position to which unit 45 is adjusted by operating eccentric 94, anvil 46 is positioned so that auxiliary images will not be printed on container 16. Stepping of belt means 85 may be discontinued by removing link 70. This may be accomplished readily by merely removing the connecting pins at opposite ends 71, 72 of link 70.

In the embodiment that has been described up to this point a single relatively wide printing belt 85 is illustrated. In the remaining Figures (FIGS. 11–18) the direct printing belt means illustrated consists of a plurality of relatively narrow belts whose lengths differ from one another by an incremental length, as described in the aforesaid U.S. Pat. No. 4,884,504.

Now referring more particularly to the second embodiment of this invention which is illustrated in FIGS. 11 through 18 and includes direct printing unit 145 that is a direct replacement for unit 45. Because of this, means for mounting unit 145 to blanket wheel 40 and the cam-ratchet means for incremental stepping of the printing belt means in unit 145 will not be repeated.

Unit 145 includes side plates 146, 147 that are maintained in spaced parallel relationship by anvil support 148 and support a plurality of transverse shafts 149 through 155. The end of shaft 150 that extends through side plate 146 is supported therein by one-way clutch 157. Rocker 59 is pivotally mounted at the free end of shaft 150 that extends through plate 146 and ratchet wheel 65, keyed to shaft 156, is interposed between plate 146 and rocker 59. Keyed to shaft 150 is drive sprocket 156. Unit 145 is provided with a plurality of relatively narrow printing belt means 201-204 which are stepped to move in the respective closed loop paths illustrated in FIGS. 15 through 18.

Each of these loops is partially defined by an individual tensioner arm at a curved corner of relatively large radius. That is, belt 201 is supported at curved corner 163 of tensioner arm 159. Pivot 160 at the end of arm 159 remote from corner 163 mounts arm 159 to anvil support 148. Eccentric 162 is keyed to shaft 161 that is pivotally mounted to anvil support 148 and extends through a clearance aperture in plate 146. The edge of eccentric 162 engages the edge of arm 159 to adjust the position thereof relative to anvil support 148 and in so doing adjusts the tension for belt 201.

Outboard of plate 146 adjusting shaft 161 extends through a clearance aperture in lock member 143 and is clamped thereto by tightening screw 164. In a similar manner screw 165 clamps adjusting shaft 166 that also extends through locking member 143. At the end of shaft 166 remote from member 143 shaft 166 mounts eccentric 177 which is engaged with tensioner arm 168 having large radius corner 169 which partially defines the path for belt 202. Large radius corner 171 (FIG. 17) of tensioner arm 172 partially defines the path for belt 203. Arm 172 is adjustable through the operation of cam 173 mounted on shaft 174 extending through a clearance aperture in another locking member 143 that is outboard of side plate 147. Stub shaft 176 mounts eccentric 177 for adjusting tensioner arm 178 having relatively large diameter corner 179 that partially defines the loop path for printing belt 204 (FIG. 18) and extends through locking member 143 that is disposed outboard of side plate 147.

As explained in the aforesaid U.S. Pat. No. 4,884,504, belt 202 is an incremental length longer than belt 201, belt 203 is an incremental length longer than belt 202 and belt 204 is an incremental length longer than belt 203. These differences in length are accounted for by the sizes of adjustable arms 159, 168, 172 and 178, respectively, and in the case of the longest belt 204, its path is partially defined by guide 181 on shaft 151. For each of the belts 201–204, between its adjusting arm mounted roller 163, 169, 171 and 179, respectively and drive sprocket 156, the path is defined by idler 182 on shaft 149 and anvil 180. The latter is secured to anvil mounting member 148.

Each of the belts 201–204 is a so-called timing belt having transverse interior teeth that extend across the entire width thereof. When the exterior surface of the printing belts 201–204 are supported by an idler, this idler is recessed at the center thereof so that the raised ink carrying printing components do not play any part in adjusting belt tension. As an example see idlers 182 (FIG. 14) having narrow ledges 141, 142 which engage margins along the edges of the respective printing belts 201–204.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Continuous motion apparatus for decorating cylindrical containers, said apparatus including:

a continuously rotating mandrel carrier having a plurality of rotatable container carrying mandrels positioned along its periphery;

a continuously rotating blanket wheel having its periphery adjacent the periphery of mandrel carrier;

a plurality of blanket segments on said blanket wheel disposed along the periphery thereof, and mounted so that during rotation of said blanket wheel all of said blanket segments remain fixed relative to each other;

a plurality of printing cylinders adjacent the periphery of the blanket wheel;

inking means for applying a different color ink to each of said printing cylinders which in turn apply differently colored picture segments to each of said blanket segments to form a complete main image thereon for transfer to the outer cylindrical surface of a container mounted on one of said mandrels, which container is in rolling engagement with said blanket segment as it passes through a printing zone;

an individual direct printing unit associated with an individual one of said blanket segments;

each of said direct printing units including a printing means that prints an auxiliary image directly on said cylindrical surfaces as the containers pass through the printing zone;

said printing means including a closed loop flexible belt means having a plurality of printing plate segments disposed in tandem along the length thereof, guide means for directing said flexible belt means along a closed loop path, said guide means including a rotatable drive roll and an anvil disposes behind an individual plate segment to support the latter in a printing position while it is applying the auxiliary image to the container, means for stepping said drive roll for each revolution of said blanket roll by an incremental distance such that a plate segment that is supported by said anvil and has applied an auxiliary image is moved off of said anvil and is replaced in said printing position by the next upstream plate segment;

support means mounting said printing unit on said blanket wheel for movement of said printing unit in its entirety relative to said blank wheel selectively by a machine operator, while rotation of said blanket wheel is stopped, between an operative position wherein said containers normally engage said belt means and an inoperative position wherein said containers and said belt means fail to engage as said blanket wheel and said mandrel wheel rotate;

after being moved to said inoperative position by a machine operator, said printing unit in its entirety remaining fixed in said inoperative position relative to said blanket wheel while the latter rotates;

said printing unit when in both said operative and inoperative positions being mounted on said blanket for continuous rotation therewith;

after being moved to said operative position, said printing unit remaining continuously at said operative position during continuous rotation of said blanket wheel; and after being moved to said inoperative position, said printing unit remaining continuously at said inoperative position during continuous rotation of said blanket wheel.

2. Continuous motion container decorating apparatus as set forth in claim 1 in which the support means comprises a pivotal mounting extending parallel to the rotational axis of said blanket wheel.

3. Continuous motion container decorating apparatus as set forth in claim 1 also including adjusting means operable when said printing unit is mounted on said blanket wheel to adjust printing pressure between said belt means and containers engaged thereby.

4. Continuous motion apparatus for decorating cylindrical containers, said apparatus including:

a continuously rotating mandrel carrier having a plurality of rotatable container carrying mandrels positioned along its periphery;

a continuously rotating blanket wheel having its periphery adjacent the periphery of mandrel carrier;

a plurality of blanket segments on said blanket wheel disposed along the periphery thereof, and mounted so that during rotation of said blanket wheel all of said blanket segments remain fixed relative to each other;

a plurality of printing cylinders adjacent the periphery of the blanket wheel;

inking means for applying a different color ink to each of said printing cylinders which in turn apply differently colored picture segments to each of said blanket segments to form a complete main image thereon for transfer to the outer cylindrical surface of a container mounted on one of said mandrels, which container is in rolling engagement with said blanket segment as it passes through a printing zone;

an individual direct printing unit associated with an individual one of said blanket segments;

each of said direct printing units including a printing means that prints an auxiliary image directly on said cylindrical surfaces as the containers pass through the printing zone;

said printing means including a closed loop flexible belt means having a plurality of printing plate segments disposed in tandem along the length thereof, guide means for directing said flexible belt means along a closed loop path, said guide means including a rotatable drive roll and an anvil disposes behind an individual plate segment to support the latter in a printing position while it is applying the auxiliary image to the container, means for stepping said drive roll for each revolution of said blanket roll by an incremental distance such that a plate segment that is supported by said anvil and has applied an auxiliary image is moved off of said anvil and is replaced in said printing position by the next upstream plate segment;

support means mounting said printing unit as a whole on said blanket wheel for movement of said printing unit as a whole selectively by a machine operator between an operative position wherein said containers normally engage said belt means and an inoperative position wherein said containers and said belt means fail to engage as said blanket wheel and said mandrel wheel rotate;

said printing unit when in both said operative and inoperative positions being mounted on said blanket for continuous rotation therewith;

after being moved to said operative position, said printing unit remaining continuously at said operative position during continuous rotation of said blanket wheel;

after being moved to said inoperative position, said printing unit remaining continuously at said inoperative position during continuous rotation of said blanket wheel;

each of said printing units having its anvil positioned in the vicinity of the trailing end of the blanket segment associated with said printing unit, and each of said blanket segments including a narrow trailing edge portion for positively rotating containers as the auxiliary images are being applied thereto.

5. Continuous motion container decorating apparatus as set forth in claim 4 in which the flexible belt means comprises a timing belt having teeth that extend across its interior surface, said timing belt having said plate segments on its exterior surface.

6. Continuous motion container decorating apparatus as set forth in claim 4 in which the means for stepping the drive roll comprises link means, cam means at one end of said link means, said drive roll being at the other end of said link means.

7. Continuous motion container decorating apparatus as set forth in claim 6 also including a pawl and ratchet means interposed between said drive roll and said other end of said link means.

8. Continuous motion container decorating apparatus as set forth in claim 7 also including a one-way clutch that limits rotation of said drive roll to a single direction.

9. Continuous motion container decorating apparatus as set forth in claim 6 in which for each of the units there is a rocker interposed between the link means and the cam means, and a follower connected to said rocker and operatively engaged with said cam means.

10. Continuous motion container decorating apparatus as set forth in claim 6 in which the link means is removable to permit the unit to remain mounted on the continuously rotating blanket wheel without the drive roll being stepped.

11. Continuous motion container decorating means as set forth in claim 4 in which the belt means comprises a plurality of relatively narrow closed loop belts each of a different length equal to an integral number of said incremental distances, and each of the belts being stepped by an incremental distance for each revolution of the blanket wheel.

12. Continuous motion container decorating means as set forth in claim 11 in which there is an individually operable means for adjusting tension of each belt.

13. Continuous motion container decorating means as set forth in claim 12 in which for each belt means for adjusting tension thereof includes an eccentric operable from outside the direct printing unit and means operable from outside the direct printing unit to lock the eccentric means in its adjusted position.

14. Continuous motion apparatus for decorating cylindrical containers, said apparatus including:

a continuously rotating mandrel carrier having a plurality of rotatable container carrying mandrels positioned along its periphery;

a continuously rotating blanket wheel having its periphery adjacent the periphery of mandrel carrier;

a plurality of blanket segments on said blanket wheel disposed along the periphery thereof, and mounted so that during rotation of said blanket wheel all of said blanket segments remain fixed relative to each other;

a plurality of printing cylinders adjacent the periphery of the blanket wheel;

inking means for applying a different color ink to each of said printing cylinders which in turn apply differently colored picture segments to each of said blanket segments to form a complete main image thereon for transfer to the outer cylindrical surface of a container mounted on one of said mandrels, which container is in rolling engagement with said blanket segment as it passes through a printing zone;

an individual direct printing unit associated with an individual one of said blanket segments;

each of said direct printing units including a printing means that prints an auxiliary image directly on said cylindrical surfaces as the containers pass through the printing zone;

said printing means including a closed loop flexible belt means having a plurality of printing plate segments disposed in tandem along the length thereof, guide means for directing said flexible belt means along a closed loop path, said guide means including a rotatable drive roll and an anvil disposes behind an individual plate segment to support the latter in a printing position while it is applying the auxiliary image to the container, means for stepping said drive roll for each revolution of said blanket roll by an incremental distance such that a plate segment that is supported by said anvil and has applied an auxiliary image is moved off of said anvil and is replaced in said printing position by the next upstream plate segment;

support means mounting said printing unit as a whole on said blanket wheel for movement of said printing unit as a whole selectively by a machine operator between an operative position wherein said containers normally engage said belt means and an inoperative position wherein said containers and said belt means fail to engage as said blanket wheel and said mandrel wheel rotate;

said printing unit when in both said operative and inoperative positions being mounted on said blanket for continuous rotation therewith;

after being moved to said operative position, said printing unit remaining continuously at said operative position during continuous rotation of said blanket wheel;

after being moved to said inoperative position, said printing unit remaining continuously at said inoperative position during continuous rotation of said blanket wheel;

said anvil being remote from said drive sprocket and being non-rotatable;

said anvil including a curved support surface disposed inside of said loop path to support said plate segments while they are in said printing position;

said belt sliding along said support surface as said drive roll is rotated; and with said printing unit in said operative position, said support surface being essentially in curved alignment with said blanket segments.

15. Continuous motion decorating apparatus as set forth in claim 14 in which the flexible belt means comprises a timing belt having teeth that extend across its interior surface, said timing belt having said plate segments on its exterior surface.

16. Continuous motion apparatus for decorating cylindrical containers, said apparatus including:

a continuously rotating mandrel carrier having a plurality of rotatable container carrying mandrels positioned along its periphery;

a continuously rotating blanket wheel having its periphery adjacent the periphery of mandrel carrier;

a plurality of blanket segments on said blanket wheel disposed along the periphery thereof, and mounted so that during rotation of said blanket wheel all of said blanket segments remain fixed relative to each other;

a plurality of printing cylinders adjacent the periphery of the blanket wheel;

inking means for applying a different color ink to each of said printing cylinders which in turn apply differently colored picture segments to each of said blanket segments to form a complete main image thereon for transfer to the outer cylindrical surface of a container mounted on one of said mandrels, which container is in rolling engagement with said blanket segment as it passes through a printing zone;

an individual direct printing unit associated with an individual one of said blanket segments;

each of said direct printing units including a printing means that prints an auxiliary image directly on said cylindrical surfaces as the containers pass through the printing zone;

in a single pass through said printing zone, said container rotates in the order of a single revolution about its own axis and during said single pass both said main and auxiliary images are applied to said container;

said printing means including a closed loop flexible belt means having a plurality of printing plate segments disposed in tandem along the length thereof, guide means for directing said flexible belt means along a closed loop path, said guide means including a rotatable drive roll and an anvil disposed behind an individual plate segment to support the latter in a printing position while it is applying the auxiliary image to the container, means for stepping said drive roll for each revolution of said blanket roll by an incremental distance such that a plate segment that is supported by said anvil and has applied an auxiliary image is moved off of said anvil and is replaced in said printing position by the next upstream plate segment;

said anvil being remote from said drive sprocket and being non-rotatable;

said anvil including a curved support surface disposed inside of said loop path to support said plate segments while they are in said printing position;

said belt sliding along said support surface as said drive roll is rotated; and with said printing unit in said operative position, said support surface being essentially in curved alignment with said blanket segments;

said flexible belt means comprising a timing belt having teeth that extend across its interior surface, said timing belt having said plate segments on its exterior surface.

* * * * *